US010830030B2

(12) United States Patent
Antonsen et al.

(10) Patent No.: US 10,830,030 B2
(45) Date of Patent: Nov. 10, 2020

(54) SYSTEM AND METHOD FOR STIMULATING A WELL

(71) Applicant: COMITT WELL SOLUTIONS US HOLDING INC., Katy, TX (US)

(72) Inventors: Roger Antonsen, Houston, TX (US); Peter Kris Cleven, Houston, TX (US)

(73) Assignee: COMITT WELL SOLUTIONS US HOLDINGS INC., Katy, TX (US)

( * ) Notice: Subject to any disclaimer, the term of this patent is extended or adjusted under 35 U.S.C. 154(b) by 75 days.

(21) Appl. No.: 15/978,676

(22) Filed: May 14, 2018

(65) Prior Publication Data

US 2018/0258745 A1 Sep. 13, 2018

Related U.S. Application Data

(63) Continuation of application No. 15/728,337, filed on Oct. 9, 2017, now Pat. No. 9,995,123, which is a continuation of application No. PCT/NO2016/050136, filed on Jun. 22, 2016.

(30) Foreign Application Priority Data

Jun. 22, 2015 (NO) ..... 20150652

(51) Int. Cl.

| | |
|---|---|
| ***E21B 23/01*** | (2006.01) |
| ***E21B 33/128*** | (2006.01) |
| ***E21B 43/26*** | (2006.01) |
| ***E21B 23/00*** | (2006.01) |
| ***E21B 43/267*** | (2006.01) |
| ***E21B 33/124*** | (2006.01) |
| ***E21B 34/12*** | (2006.01) |

(52) U.S. Cl.

CPC ..... *E21B 43/26* (2013.01); *E21B 23/006* (2013.01); *E21B 23/01* (2013.01); *E21B 33/124* (2013.01); *E21B 33/128* (2013.01); *E21B 34/12* (2013.01); *E21B 43/267* (2013.01)

(58) Field of Classification Search

CPC ..... E21B 33/128; E21B 34/12; E21B 34/14; E21B 23/01

See application file for complete search history.

(56) References Cited

U.S. PATENT DOCUMENTS 4,474,239 A * 10/1984 Colomb ..... E21B 43/04 166/278

* cited by examiner

*Primary Examiner* — Catherine Loikith
(74) *Attorney, Agent, or Firm* — Pierson IP, PLLC

(57) ABSTRACT

A system for stimulating a well with an annulus formed by a string and a wellbore. The system includes an injection assembly with at least two zone isolation packers configured to set upstream and downstream of a target zone at pressures above a predetermined activation pressure, and unset at pressures below the activation pressure.

18 Claims, 3 Drawing Sheets

SYSTEM AND METHOD FOR STIMULATING A WELL

FIELD OF THE INVENTION

The present invention concerns a system and a method for stimulating a well.

PRIOR AND RELATED ART

As the term is used herein, a wellbore is a fully or partly cased borehole extending through layers in an underground geological structure, hereinafter a formation. A well is a borehole with equipment needed for its operation, e.g. for producing oil or gas from a reservoir, for producing geothermal energy or for injecting fluids for enhanced oil recovery or for storing $CO_2$. The well may be placed onshore or offshore, and the invention is neither limited to any particular industry nor to the purpose of the well.

A well may extend more or less horizontally. For ease of explanation, the terms "upstream" and "uphole" are used herein for the direction toward the surface regardless of the actual direction of a fluid flow or the inclination of the wellbore. Similarly, "downstream" and "downhole" refer to the opposite direction, i.e. away from the surface.

Stimulating or treating a well means to improve its performance, typically by improving the fluid flow between the formation and wellbore. As used herein, stimulating a well, "stimulation" for short, involves increasing an injection pressure to force some agent, e.g. acid or a propping agent, into the formation, and reduce the pressure when the agent is injected. Hydraulic fracturing of a production well for hydrocarbons, i,e, oil and/or gas, will be used as a non-limiting example in the following.

In the oil and gas industry, a "zone" includes a layer containing hydrocarbons. In the present example, a casing is perforated at the zones. The "target zone" is the zone to be stimulated.

Hydraulic fracturing is performed by pumping a liquid into the formation at a pressure sufficient to create fractures in the formation. When the fracture is open, a propping agent is added to the liquid. The propping agent remains in the fractures to keep them open when the pumping rate, and hence the pressure, decreases.

The break-down pressure, i.e. the pressure required to create fractures in the formation, depends on the compressive pressure in, and the strength of, the formation. Thus, the break-down pressure and its associated injection rate vary significantly between applications. In the present example, the fractures would ideally be wings extending into the target zone, and a layer of impermeable rock above the porous layer containing oil or gas would prevent the fractures from extending. However, fractures, faults etc. already present in the formation will usually cause a tree-like fracture structure in the zone. In addition, fractures in the layers adjacent to the layer comprising hydrocarbons may widen and cause leakages and loss to formation.

Even when water is not lost to the formation, hydraulic fracturing consumes a significant amount of water. According to Arthur, J. D., "A Comparative Analysis of Hydraulic Fracturing and Underground Injection", presented at the GWPC Water/Energy Symposium, Pittsburgh, Pa., Sep. 25-29, 2010, a water consumption of 1 000 to 20 000 bbl/day (119-2 400 $m^3$/day) is common for onshore wells in the US. To limit the water consumption, especially in arid areas, the water may be recycled on the surface.

At some point, a propping agent is added to the liquid and inserted into the fracture. The propping agent, e.g. sand or ceramic beads, remains in the fracture when the injection pressure drops, and thereby keeps the fractures open. Fracturing or other stimulation may be repeated several times during the lifetime of a well, so there is a general need to reduce the cost of re-fracturing as much as possible.

Specifically, if the cost of re-fracturing is too high, the well may be abandoned even if the reservoir is not depleted. Similarly, if low-cost re-fracturing was available, several abandoned production wells might become profitable. Similar considerations apply to production start of marginal fields, to stimulation other than hydraulic fracturing and to injection wells. Thus, there is a need to reduce the cost of stimulating and re-stimulating a well.

When assessing the profitability of stimulation or re-stimulation, at least the following potential problems and shortcomings should be considered and accounted for:

- any need for separate trips, i.e. inserting and retrieving a string once per target zone;
- cost and/or availability of water and/or recycling process water;
- high pressure injection at a target zone may force sand from the formation into the fractures and/or the wellbore at adjacent zones.

Our co-pending patent application NO20150182A1 discloses an injection assembly that solves or reduces some of the problems and shortcomings above. Specifically, the injection assembly comprises a string with an upstream packer and a downstream packer for isolating a target zone, and a normally closed injection valve between the packers. A normally open bottom valve at the very end of the string allows fluid circulation during run in, and closes when an injection rate exceeds a preset level. Water, possibly with soluble additives, is used for the circulation. The return water typically contains sand and other solid particles, which are relatively easy to remove. Inexpensive recycling reduces water consumption and cost of operation. After injection, the apparatus is reset such that it can be moved to a new target zone where the process is repeated. Thus, several zones can be stimulated in one trip, which saves time and reduces operational costs.

The packers in the injection assembly are called "zone isolation packers" in the following to avoid confusion with packers that may be present uphole from the injection assembly.

In some applications, sand and gravel from the formation enters the annulus between the string and inner wall of the wellbore. The produced sand enters the annulus during or after stimulation, e.g. at the target zone when the injection pressure drops after stimulation. During stimulation, a high injection pressure may leak to regions of the wellbore away from the target zone. If the wellbore is open hole, i.e. uncased, or the casing has perforations in this region, produced sand may enter the annulus above the packers isolating the target zone during stimulation. Regardless of cause or path, produced sand in the annulus may prevent the string and injection assembly from moving to the next target zone or to the surface.

An objective of the present invention is to improve the injection assembly described above, in particular to reduce the effects of produced sand in the annulus around the string used for stimulating a target zone.

SUMMARY OF THE INVENTION

This is achieved by a system according to claim 1 and a method according to claim 10.

In a first aspect, the invention provides a system for stimulating a well with an annulus formed by a string and a wellbore. The system comprises an injection assembly with at least two zone isolation packers configured to set upstream and downstream of a target zone at pressures above a predetermined activation pressure, and unset at pressures below the activation pressure. The injection assembly has a normally closed injection valve arranged between the zone isolation packers and configured to open at pressures above the activation pressure and close at pressures below the activation pressure. Finally, the injection assembly has a normally open flow activated bottom valve configured to close at flowrates above a predetermined flow rate and open at flowrates below the predetermined flow rate. The system further comprises a sand control element configured to seal the annulus in response to a first sequence of string motions and to retract in response to a second sequence of string motions. A mechanically operated sand control valve is arranged between the sand control element and the injection assembly, and is configured to open in response to a third sequence of string motions and to close in response to a fourth sequence of string motions. A releasable anchor is configured to be set in the wellbore downstream from the sand control valve, and each string motion is a motion of the string relative to the anchor selected from a motion group consisting of down-weight, pull-up and right-hand turn.

The sand control element prevents produced sand from the formation, i.e. uphole from the injection assembly, from moving further uphole through the annulus e.g. during stimulation. After stimulation, the sand control valve opens to flush the produced sand back into the formation. This prevents produced sand from packing around the string, and ensures that the system can be moved from one target zone to the next, thereby stimulating all taret zone during one trip. In turn, this reduces operational cost significantly.

The injection assembly is essentially operated by bore pressure, whereas the sand control element and sand control valve are operated by moving the string relative to the anchor. Thus, the sand control element and sand control valve, i.e. the sand control assembly, can be operated independently of the injection assembly as long as the anchor is set. The anchor as such is not part of the invention. Depending on the application and the selected anchor, a sequence of down-weights, pull-ups and right-hand turns is used to operate the sand control assembly.

The anchor is preferably lockable. Specifically, it should be locked during run-ins so that it does set unintentionally as the system moves upstream or downstream within the wellbore. A lockable anchor must be unlocked before it is set.

In some embodiments, the anchor is operable by a combination of motions selected from the motion group. Such an anchor is set and unset by applying down-weights, pull-ups and right-hand turns to the string at the surface uphole from the well. Alternatively, the anchor may be hydraulic, i.e. be set and unset by the bore pressure in the same manner as the zone isolation packers. In either case, the anchor must be set to provide a reactive force for operating the sand control assembly, i.e. before the sand control element can be set and the sand control valve can be opened.

In a preferred embodiment, the first and third sequences of string motions are identical, so that the sand control element is set when the sand control valve opens. This simplifies the design of the sand control assembly, as one control mechanism, e.g. a J-slot with associated pin, activates two devices, i.e. the sand control element and the sand control valve.

Similarly, the design is simplified if the second and fourth sequences of string motions are identical, so that the sand control element is unset when the sand control valve closes.

If the anchor is mechanical set, the second and fourth sequences of string motions are preferably identical to the combination for releasing the anchor. For example, a pull-up, right-hand turn may simultaneously close the sand control valve, unset the sand control element, unset the anchor and lock the above devices for run-in, here defined as moving the system within the wellbore.

Some embodiments comprises a pressure activated packer for stopping sand and/or pressure that enters the annulus uphole from the injection assembly. The pressure activated packer is preferably of the same kind as the zone isolation packers. Details can be found in NO20150182A1 mentioned above. A packer that increases the sealing with increasing pressure is preferred if there is a risk for leakage from the formation into the annulus upstream from the injection assembly, e.g. during stimulation. Alternatively, the sand control element could be designed to seal against higher pressures, but this would increase the investment and operational costs in applications where a less demanding seal is required.

The system may further comprise a check valve within the string upstream from the sand control valve, such that the check valve prevents a return flow toward the surface. Thus, the sand control valve may be designed for commonly occurring pressures, and the optional check valve handles peak applications. The rationale and benefits are similar to those for the optional pressure activated packer discussed above.

In a second aspect, the invention provides a method for stimulating a well with an annulus formed by a string and a wellbore using the system explained above. The method comprises the steps of:

a) moving the injection assembly within the wellbore to a target zone;
b) unlocking the anchor;
c) setting the anchor, thereby fixing it to the wellbore;
d) increasing a pump rate of liquid through the string such that the zone isolation packers are set and the injection valve opens;
e) stimulating the target zone;
f) decreasing the pump rate such that the injection valve closes and the zone isolation packers unset, but the bottom valve remains closed;
g) setting the sand control element;
h) opening the sand control valve;
i) flushing the annulus by expelling liquid through the sand control valve;
j) closing the sand control valve;
k) unsetting the sand control element;
l) repeating steps a)-k) until last target zone is stimulated; and
m) retrieving the string from the well.

The method requires a preferred embodiment of the system. The anchor may be mechanically or hydraulically operated, and the benefits of the method are the same as for the system discussed previously.

In a preferred embodiment, unlocking the anchor involves a pull-up and a right-hand turn;

setting the anchor involves applying a down-weight;

setting the sand control element and opening the sand control valve involves increasing the down-weight; and closing the sand control valve, unsetting the sand control element and releasing the anchor are performed simultaneously by a pull-up and a right-hand turn.

While keeping the anchor and other components in tension is feasible for shallow target zones, the cost of lifting the string and associated system increases rapidly with the depth of the target zone. Hence, the preferred embodiment is set by a down-weight, and other actions are triggered by short-termed pull-ups. The pull-ups are preferably combined with right-hand turns, as there is a general need to remove an activation element from an axial recess in a circumferential direction. A spring providing the required displacement would have to be overcome by applied forces in other parts of the sequence, and hence be a cost without benefit.

Further features and benefits of the invention will appear from the following detailed description.

BRIEF DESCRIPTION OF THE DRAWINGS

The invention will be described by means of examples and with reference to the accompanying drawings, in which.

The drawings are schematic and intended to illustrate principles of the invention. They are not necessarily to scale, and numerous details known to the skilled person are omitted for clarity.

Figure 1:
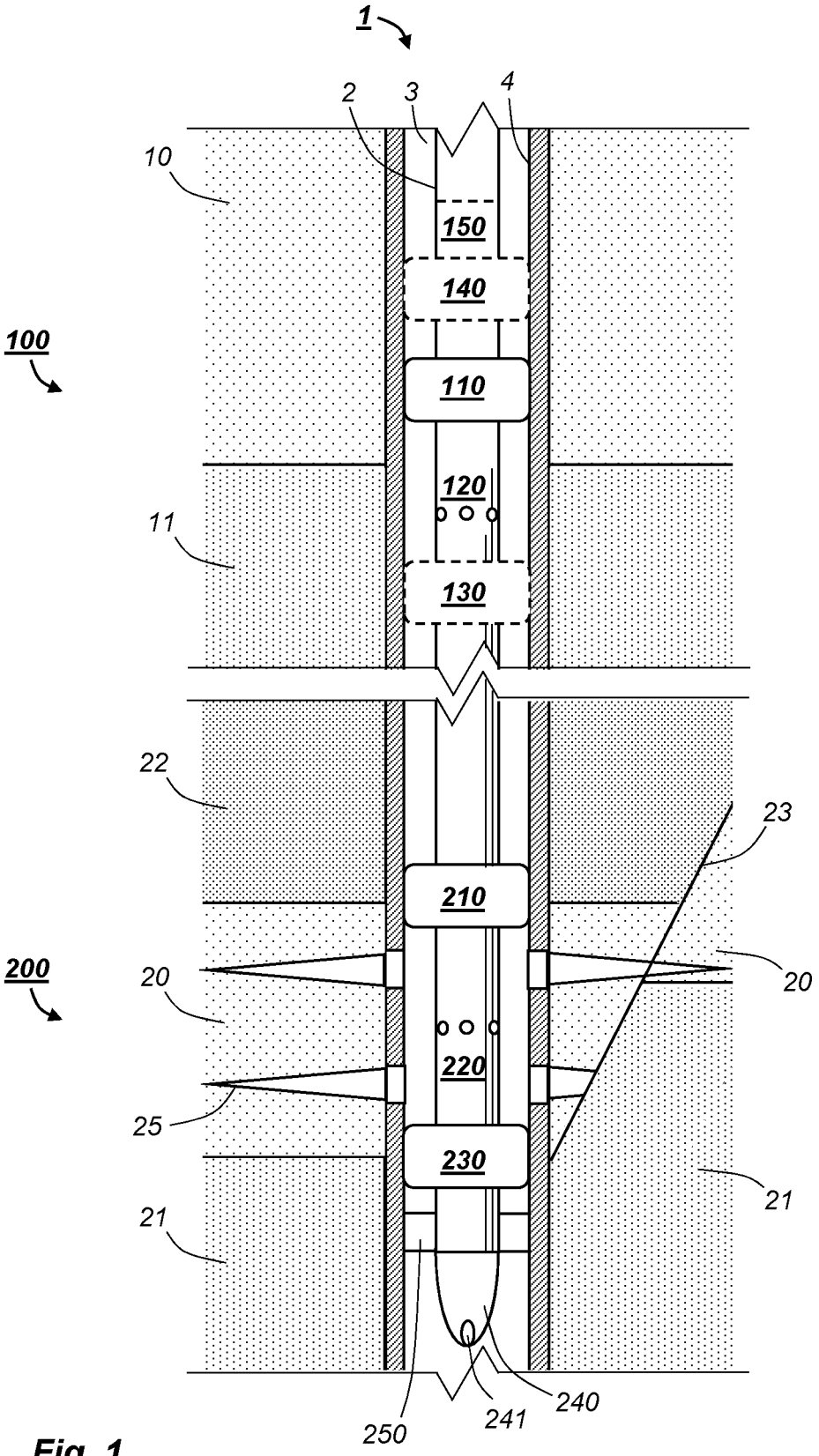
FIG. 1 illustrates a system according to the invention inserted into a wellbore.

FIG. 1 illustrates main components of a system 1 according to the invention. A hollow string 2 running from the surface connects all components in the system 1. In some applications, the string 2 may be coiled tubing. In this example, however, the string 2 comprises standard tubular joints connected by threaded pins and boxes.

In FIG. 1, the string 2 is inserted into a wellbore, i.e. a borehole with a steel casing 4 cemented to a surrounding formation along all or part of the borehole. The casing 4 extends through layers 10, 11, 22, 20 and 21 of the formation. Each layer comprises a different type of rock. The target zone 20 is the zone currently being treated or stimulated. Any zone comprises a porous rock type, e.g. sand stone, shale or limestone, with hydrocarbons. As the rock is porous, it is easily broken down to sand and gravel during stimulation and re-stimulation.

A denser rock type is required above any zone to prevent the hydrocarbons in the zone from migrating to the surface. This is illustrated by layer 22 above the target zone 20.

The casing 4 is perforated at zone 20 to permit a fluid flow from the zone 20 into a production string during production, or from the string 2 to the zone 20 during stimulation, e.g. hydraulic fracturing to create fractures 25. The fractures 25 are shown as idealized wings extending from the perforations in the casing 4. In reality, they may form a tree-like structure and/or contain sand and gravel from the formation.

On the right hand side of FIG. 1, the layers 20 and 21 are shifted upward along a fault plane 23. Faults 23 and fractures caused by shifts in the Earth's crust and manmade fractures 25 may provide a fluid path such that hydraulic fracturing of zone 20 may cause sand to enter the annulus 3 somewhere upstream from the target zone 20.

The system 1 comprises a sand control assembly 100 and an injection assembly 200. The purpose of the sand control assembly 100 is to remove produced sand and gravel from the annulus 3, such that the system 1 may move on to another target zone or to the surface. As a formation may produce sand somewhere upstream from the target zone 20 as explained above, and as the casing 4 may have holes through which the produced sand may enter the annulus 3, the distance between the assemblies 100 and 200 must be adapted to the application at hand. However, a distance in the range 10-30 m (~30-100 ft) is believed to be suitable in most cases.

For ease of description, the term "mechanically operated" is used herein for devices operated by moving the string 2, as opposed to "pressure activated" devices, which are operated by changing a bore pressure within the string 2. As a rule, the sand control assembly 100 is mechanically operated by uphole motions of the string 2, but will be unaffected by pressure. On the other hand, the injection assembly 200 is pressure activated, and will not be affected by uphole motions of the string 2. However, the anchor 250 at the injection assembly 200 may be set and unset by moving string 2 or by adjusting the bore pressure in the case of a hydraulic anchor. Optional packers 130, 140 at the sand control assembly 100 may seal by bore pressure.

The sand control assembly 100 comprises a mechanically operated sand control element 110 and a mechanically operated sand control valve 120. The purpose of the sand control valve 120 is to flush sand from the annulus 3, for example after a fracturing operation. This requires a certain flushing pressure in the annulus 3 downstream from the sand control element 110, and the sand control element 110 should be designed to withstand the pressure difference caused by this flushing pressure. As it would be expensive and/or impractical to design the sand control element 110 for any thinkable pressure difference or condition in the wellbore during and after stimulation, the sand control assembly 100 may include one or more optional packers 130, 140 to handle such extraordinary conditions.

In a first example, there is no significant risk for produced sand in the region around the sand control assembly 100. Then there is no need for additional packers 130, 140.

In a second example, a high injection pressure and a leaky formation injects significant amount of sand into the annulus 3 during stimulation. If the sand control element 110 is set after the stimulation, the sand may prevent element 110 from sealing against the casing 4. In this case, it would be practical to arrange a pressure activated packer 130, preferably of the same type as the pressure activated packers 210, 230 in the injection assembly 200, downstream from the sand control valve 120. Alternatively, it is possible to set the sand control element 110 before stimulation and open the sand control element after stimulation. This would require separate operating sequences for the element 110 and valve 120, and thus make the design of the sand control assembly 100 more complex.

In a third example, there is a risk that the element of a packer 130 downstream from the sand control valve 120 seals against the casing 4 after stimulation, e.g. because there may be a remaining pressure over a pressure activated packer 130. This would prevent flushing by an upstream valve. In this case, a pressure activated packer 140 uphole from the sand control valve might be a better idea.

The three examples above illustrate that a practical design of the sand control assembly 100 must be left to a skilled person knowing the application at hand.

In all embodiments, the sand control element 110 is retracted during run-in to allow circulation through the annulus 3 as further described below. The sand control valve 120 is normally closed. i.e. closed during run-in. A suitable sequence of string motions to set and unset the sand control element 110 and to open and close the sand control valve 120 is described with reference to FIG. 2.

An optional check valve 150 may be provided within the string 2 to ensure that liquid and/or sand is not conveyed toward the surface through the string 2, in particular if the bore pressure may become less than the pressure in annulus 3, e.g. shortly after a high-pressure injection.

The injection assembly 200 in FIG. 1 comprises two zone isolation packers 210, 230, one packer 210 upstream from the target zone 20, and one 230 downstream from the target zone 20. e packer 210, an injection valve 220, a downstream packer 230 and a normally open bottom valve 240. The assembly works in the manner described with reference to NO20150182A1 in the introduction. In addition, the injection assembly 200 may comprise a complementary valve (not shown) as disclosed in our patent application NO20150459A1. The complementary valve is designed to remove the pressure difference over the injection assembly 200 after a predetermined time delay, usually a few minutes. Thus the packers 210, 230 are set when the bore pressure exceeds a predetermined activation pressure and unset when the bore pressure drops below the activation pressure, optionally after a time-delay. Similarly, the injection valve 220 is open at bore pressures above the activation pressure and closes, possibly after a time-delay, when the bore pressure drops below the activation pressure.

During run-in, i.e. when the system 1 moves along the wellbore, a limited flow of liquid exits the string 2 through an opening 241 and returns to the surface through the annulus 3 between the string 2 and the casing 4. The liquid is typically water, possibly with additives to prevent scaling, corrosion etc., but without propping agent. The flowrate is relatively low, for example about 600 l/h (~5 bbl/h) or 10-20% of the injection flow associated with the break down pressure.

In the state shown in FIG. 1, the bottom valve 240 is closed, packers 210 and 230 are set to isolate zone 20, and fluid containing a propping agent is injected by means of the injection valve 220. As noted in the introduction, the injection rate associated with the break down pressure vary widely between applications. Values above 1 l/s (30 bbl/h) are common.

As shown in FIG. 1, an anchor 250 engages the casing 4 and prevents axial and rotational motion of the injection assembly 200. Thus, the anchor 250 provide the reactive forces required for operating the sand control assembly 100 by pushing, pulling and turning the string 2 from the surface. In the following, the different string motions are called "down-weight", "pull-up" and "right-hand turn" in accordance with common usage. Specifically, the string 2 above the sand control assembly 100 is moved uphole, downhole or in right-hand turns relative to the anchor 250 and the casing 4. Left hand turns are not permitted within the wellbore, as they would loosen the connecting threads in the system 1 and/or string 2. At the surface, i.e. out of the wellbore, left hand turns are required to break up the string 2.

The anchor 250 is an off-the-shelf component, and either mechanical set or hydraulic. It must be set in the casing 4 for operation of the sand control assembly 100, and is preferably locked during run-in.

Thus, a suitable mechanical set anchor 250 has an element, e.g. a spring loaded dog, that provides sufficient friction with the casing 4 to permit an unlock combination. Such anchors typically comprise a J-slot or the like to provide a desired sequence of operation. In the present example, pull-up, right-hand turn unlocks the anchor 250. Once unlocked, the anchor 250 is set by applying down-weight. It remains set as long as the down-weight is maintained, and is unset and locked when the down-weight is removed, e.g. due to a pull-up.

Alternatively, a hydraulic anchor 250 may be employed. This may be set by the increasing bore pressure, for example at the activation pressure that sets the isolation packers and opens the injection valve in step 306 below. The operation of a hydraulic, i.e. pressure activated, anchor is outside the scope of the present invention, and a mechanically operated anchor 250 is assumed in the following.

Figure 2:
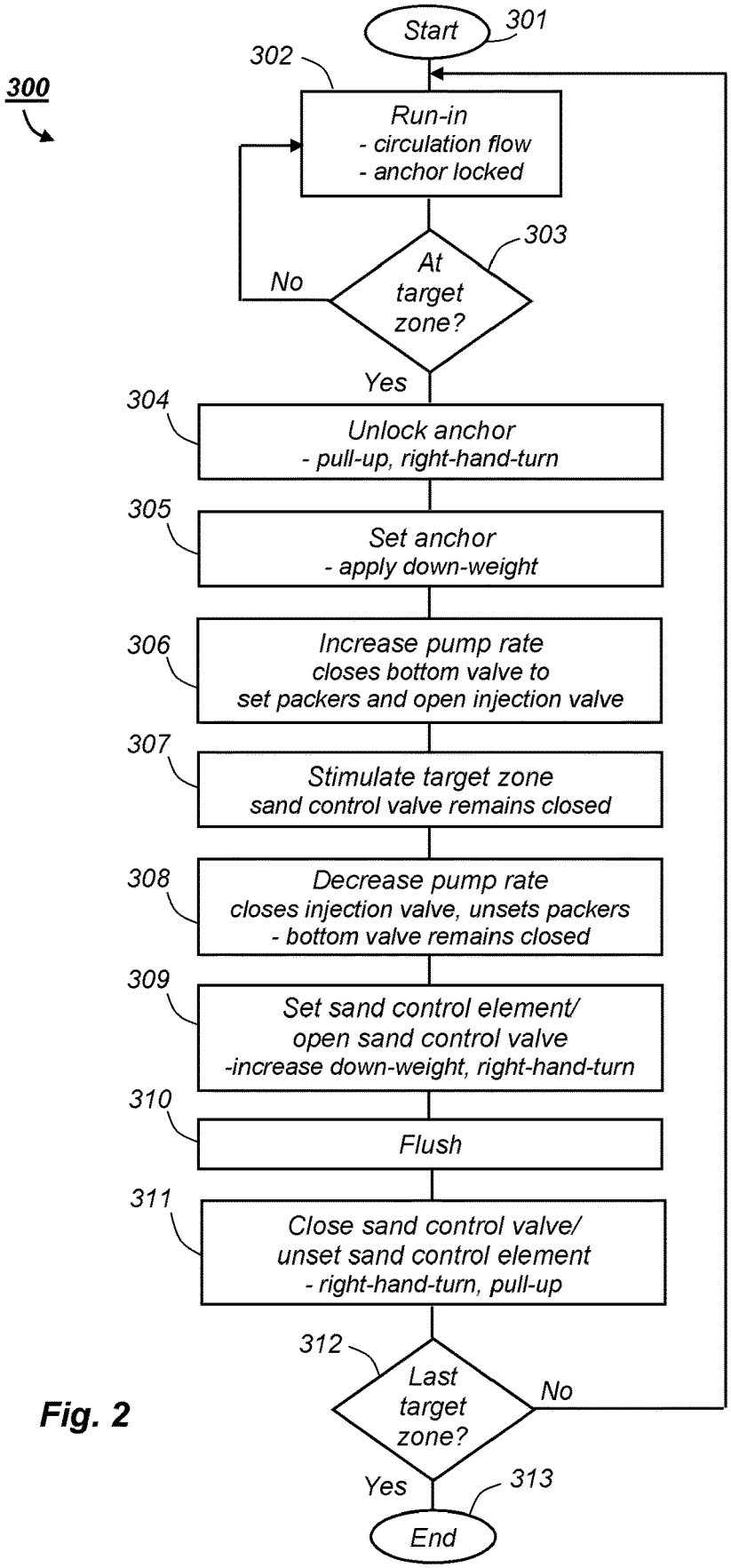
FIG. 2 is a flow diagram illustrating a method according to the invention.

FIG. 2 illustrates a method 300 for operating the system 1 described above.

The method starts in step 301. This step comprises any action required to reset the apparatus to a run-in state, i.e. a state where the system 1 can move within the wellbore.

In step 302, the system is moved, e.g. downstream along the casing 4 while rotating, while a limited flow e.g. 600-800 l/h (~5-7 bbl/h or 10-20% of stimulation flow) circulates downstream though the string 2 and back to the surface through the annulus 3. The anchor 250 remains locked until the unlocking sequence, here pull-up, right-hand turn, is performed. The circulation liquid may contain small amounts of produced sand, but is easily recycled at the surface. This saves water and reduces cost for recycling.

Test 303 determines if the injection assembly 200 has arrived at a target zone, e.g. zone 20 in FIG. 1. When the injection assembly 200 is in place, the anchor 250 is unlocked (step 304) and set (step 305). Here, the anchor 250 is set by applying down-weight through string 2.

In step 306, the pump rate is increased to a stimulation rate, e.g. 3 600-6 000 l/h (~30-50 bbl/h) for fracturing or re-fracturing. The associated increase in bore pressure, i.e. the pressure within the string 2, closes the bottom valve 240, sets the packers 210, 230 to isolate the target zone 20, and opens the injection valve 220. The increased bore pressure may also set an optional sand control packer 130, 140 as described. Pressure activated packers with a net working area exposed to the bore pressure seal better with increased bore pressure. In contrast, a sealing force applied through the string 2 would have to increase with increasing annulus pressure, so an entire control system with a pressure sensor, a controller and an actuator would be required for a mechanically operated sand control packer 130, 140.

In step 307, the target zone 20 is stimulated. In the present example, this means fracturing or re-fracturing. However, acidizing and other treatments also require an increased bore pressure for injection into a target zone, so the present invention is not limited to fracturing. During stimulation, the sand control valve 120 remains closed to prevent produced sand from entering into the string 2.

In step 308, the pump rate is decreased. This essentially resets the components in the pressure operated injection assembly 200. In particular, the injection valve 220 closes so that little or no produced sand enter into the string 2 and the packers 210 and 230 are unset. At this stage, the bottom valve 240 remains closed, such that no circulation fluid will exit through the end of string 2, but instead through the sand control valve 120 once it opens. The bottom valve 240 can be kept closed at this stage by controlling the bore pressure. Alternatively, a fixed time delay may be provided, e.g. by means of a complementary valve as described.

In step 309, one operating sequence sets the sand control element 110 and opens the sand control valve 120., in the present example increasing the down-weight and performing a right-hand turn. One or more optional packers 140, 130 may also be set before the stimulation. These are preferably pressure activated, so that the seal increases with pressure regardless of the forces applied through the string 2. In addition, sand ports in the sand control valve 120 opens in step 309. In the present example, the sand control element 110 is set and the sand control valve 120 is opened by increasing the down-weight and performing a right-hand turn on the string 2.

In step 310, water is supplied through the string 2, exits through the open sand ports in sand control valve 120, and flushes any produced sand through the annulus 3 back into the formation, for example into the fractures 25.

In step 311, the sand ports are closed and all sand control elements are unset by pulling up the string 2. This may include pressure activated devices in the mechanically operated sand control assembly 100. For example, a downstream displacement of some inner sleeve in a packer, e.g. the optional packer 130, may have trapped pressure in order to keep the packer set. Pulling up the inner sleeve in step 311 would release the trapped pressure. The pull-up in step 311 also unsets the anchor 250, which preferably also is locked by the pull-up.

Step 312 illustrates that the system 1 may be used to stimulate several target zones in one trip. If there is another target zone to stimulate, the steps 302-311 are repeated for the next target zone. If the latest stimulated target zone is the last target zone, the process ends in step 313.

Step 313 comprises any action required to retrieve the system 1 from the wellbore. However, in the present example, the string sequences are selected such that step 313 merely involves pulling out the system 1.

In particular, the anchor 250 can be moved downstream in casing 4 without setting, as it must be unlocked by a pull-up and right-hand turn before setting is possible. When the anchor 200 moves upstream, it most likely unlocks due to pull and right-hand turns, but it will not set unless a down-weight is applied.

The mechanically operated sand control assembly 100 described above is essentially activated by down-weights and deactivated by pull-up. However, the downstream part of string 2 must be immovable with respect to the casing 4 before a push, pull or turn of the string 2 affects any device described above. Normally, the anchor 250 prevents axial and rotational motion of the downstream end. The circulation through the bottom valve 240 with return path through the annulus 3 minimizes the risk for stopping the downstream end in produced sand or debris. Thus, the sand control assembly 100 may move upstream and downstream within casing 4, as long as the anchor 250 remains unset and the circulation through the bottom valve 240 is maintained.

From the description above, it should be understood that alternative sequences or combinations of down-weights, pull-ups and right-hand turns may be employed to operate the sand control assembly 100 and the anchor 250. For example, a pull-up or a down-weight may be combined with a right-hand turn without affecting the function of a device, e.g setting or unsetting the sand control element 110 or operating the sand control valve 120. In addition, the function caused by down-weight and pull-ups may be reversed throughout without affecting the functions of the system. For example, the anchor 250 might unlock by down-weight plus right-hand turn and set by pull-up. In this case, the sand control assembly 100 would be adapted to activate at pull-ups and deactivate at down-weights.

Either way, the operation sequence of the anchor 250 must permit axial or rotational motion during run-ins, and the operation sequence of the sand control assembly 100 must be adapted to the chosen anchor 250. Of course, the dimensions and other specifications of the anchor 250 must also match those required by the sand control assembly 100. The formulation "adapted to" in the claims includes operating sequence, size, strength and other parameters that must match in a real embodiment.

FIGS. 3*a-d* illustrate operation of the sand control assembly 100 shown in FIG. 1. The elements with reference numerals 102, 104, 106 are fixed with respect to the anchor 250. Elements with uneven reference numerals, the sealing sand control element 110 and sliding sleeve 123 are connected to the upstream string 2, which can rotate and move axially with respect to the anchor 250.

More particularly, a housing 102 contains a fixed control sleeve 104 with an axial recess 106. The axial recess 106 may have any suitable shape, as long as it is able to receive an activation element 107. In the present example, the trapezoid axial recess 106 and complementary activation element 107 merely illustrate the principle. The housing 102, control sleeve 104 and axial recess 106 are shown in the same position in all four FIGS. 3*a-d*, as they do not move relative to the anchor 250.

The upstream string 2 may rotate relative to the housing 102, but not relative to the sand control element 110 and a sleeve 101 downstream from the element 110. The sleeve 101 can rotate and slide axially on an upstream part of the housing 102 with reduced outer diameter.

A mandrel 103 is rotationally and axially fixed to the upstream string 2 at its upstream end and to a sliding sleeve 123 at its downstream end. The mandrel 103 can rotate and slide axially within the housing 102.

An activation sleeve 105 with extended outer diameter is attached to the mandrel 103. The housing 102 has a corresponding extended inner diameter that allows axial and rotational motion of the activation sleeve 105 within the housing 102.

Figure 3A:
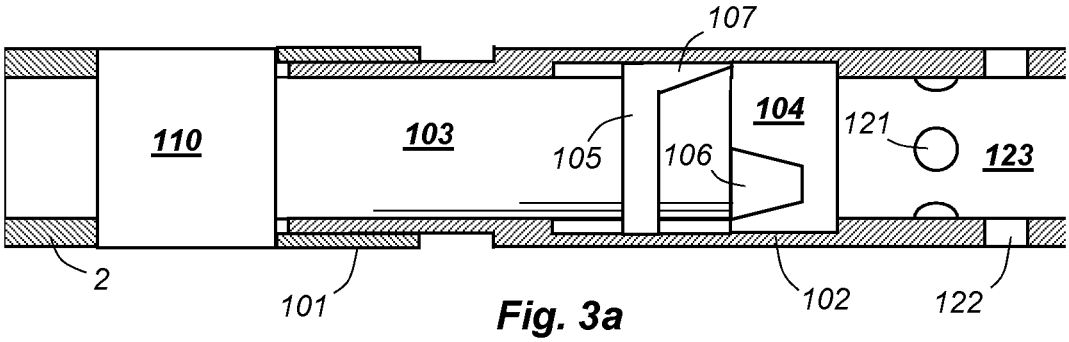
FIGS. 3*a-d* illustrates a mechanically operated sand control assembly.

FIG. 3*a* illustrates the run-in state. In this state, the activation element 107 is rotated away from the axial recess 106, and is preferably received in another axially directed recess in the control sleeve 104, such that the activation element 107 and control sleeve 104 cannot rotate relative to each other. Thereby, the downstream part of string 2, which is attached to the housing 102, rotates and moves axially with the upstream part of string 2 during run-in.

In the run-in state, the sand control element 110 remains retracted, as there are no significant axial forces between the upstream part of string 2 and the sleeve 101. That is, all axial forces are transferred through the mandrel 103. Furthermore, the sand control valve 120 remains closed because openings 121 in a sliding sleeve 123 are displaced upstream from sand control ports 122 in the housing 102. A solid part of the sliding sleeve 123 covers the sand control ports 122, and the openings 121 and ports 122 are prevented from aligning as the activation element 107 abuts the control sleeve 104.

Figure 3B:
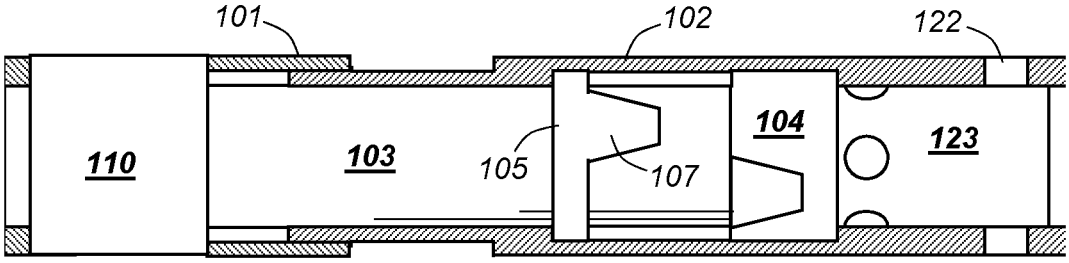

FIG. 3*b* illustrates a pull-up and right-hand turn to unlock the anchor 250 in the present example. The sand control element 110, mandrel 103 and sliding sleeve 123 is shifted upstream until the activation sleeve 105 abuts a shoulder in the housing 102. The activation element 107 is pulled out of the preferred axial recess, and has rotated a predetermined angle determined by the selected anchor, for example a 90° right-hand turn.

There are still no significant compressive axial forces acting on the sand control element 110, which remains unset. The downstream end of sliding sleeve 123 is shown downstream from the sand control ports 122 to illustrate that the sand control valve 120 remains closed.

Figure 3C:
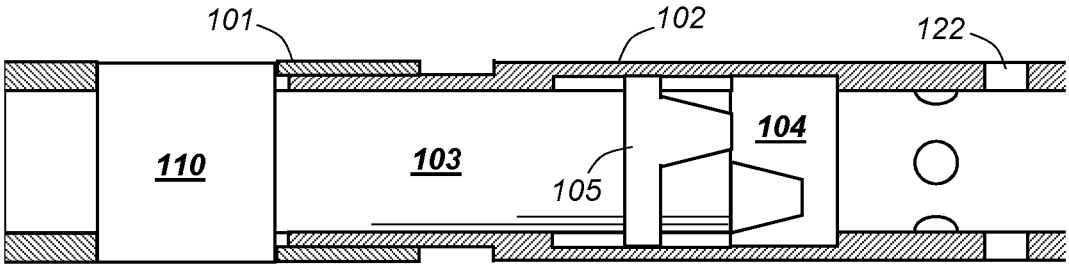

FIG. 3*c* illustrates the down-weight used to set the anchor 250. The activation element 107 abuts the control sleeve 104 outside the axial recess 106, such that a down-weight applied to the upstream part of string 2 is transferred through the mandrel 103, activation sleeve 105, control sleeve 104 and housing 102 to the downstream part of string 2.

The sand control element 110 remains unset and the sand control valve 120 remains closed for the reasons explained above.

Figure 3D:
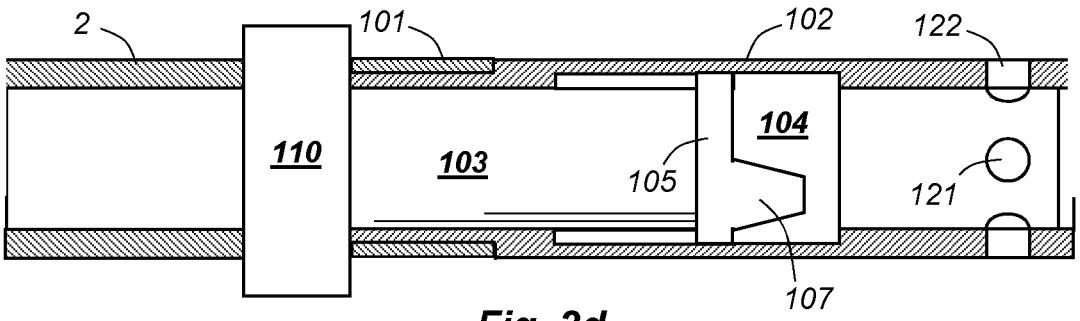

FIG. 3*d* illustrates a right-hand turn and increased down-weight for setting the sand control element 110 and opening the valve 120. The right-hand turn aligns the activation element 107 with the axial recess 106. This allows the mandrel 103 to shift further downstream within the housing 102. When the down-weight increases, the sleeve 101 abuts a shoulder on the housing 102, and the sand control element 110 expands radially due to the increased compressive axial force. This sets the sand control element 110. When the sand control element 110 is fully expanded, the mandrel 103 has moved downstream to a position where the openings 121 on the sliding sleeve 123 is aligned with the sand ports 122 in the housing 102, such that the sand control valve 120 is open.

From FIGS. 3*a-d* and the explanation above, it follows that a subsequent pull-up will shift the sliding sleeve 123 upstream, thereby closing the sand control valve 120. In addition, the sand control element 110 retracts radially. As known in the art, an elastic retraction may not be sufficient to retract the element, or may be small so that the element 110 retracts slowly. Thus, a pull-up at this point preferably also pulls on the elastic sand control element 110. A subsequent right-hand turn rotates the activation element 107 away from the axial recess 106, for example to the position shown in FIG. 3*a*, so that the process can be repeated.

In a real embodiment, the housing 102 with control sleeve 104, mandrel 103 with activation sleeve 105 etc. will probably be split and/or reconfigured, for example due to manufacturing considerations. In addition, more than one activation element 107 and corresponding axial recess 106 should preferably be distributed evenly around the circumference for load balancing.

While the invention has been explained by means of examples, many variations and modifications will be obvious to one skilled in the art. The invention is defined by the accompanying claims.

The invention claimed is:

1. A system for stimulating and flushing a well with an annulus formed by a string and a wellbore, wherein the system comprises:

an injection assembly including an upstream packer configured to set upstream of a target zone and a downstream packer configured to set downstream of the target zone, wherein the upstream packer and the downstream packer are configured to set at an activation pressure;

a control element configured to seal the annulus between the string and the wellbore, the control element being positioned upstream from the target zone and the injection assembly; and a control valve positioned upstream from the injection assembly, downstream from the control element, and between the injection assembly and the control element, the control valve includes ports that are configured to be exposed when the upstream packer and the downstream packer are unset.

2. The system of claim 1, further comprising:

an injection valve positioned between the upstream packer and the downstream packer, wherein the control element is a sand and debris control element and the control valve is a sand and debris control valve.

3. The system of claim 2, wherein the injection valve is opened when a bore pressure is above the activation pressure.

4. The system of claim 1, further comprising:

a releasable anchor configured to be set in the wellbore downstream from the control valve, the releasable anchor being configured to be set to prevent axial and rotational motion of the injection assembly.

5. The system of claim 1, further comprising:

a first sand control packer positioned upstream from the control element, the first sand control packer being configured to seal the annulus between the string and the wellbore; and a second sand control packer positioned downstream from the control element, the second sand control packer being configured to seal the annulus between the string and the wellbore, wherein the control valve is positioned downstream from the first sand control packer, upstream from the second sand control packer, and between the first sand control packer and the second sand control packer.

6. The system of claim 5, further comprising:

a check valve positioned upstream from the control valve and the first sand control packer, wherein the check valve prevents a return flow toward the surface through the string.

7. The system of claim 1, further comprising:

a bottom valve positioned on a distal end of the string.

8. The system of claim 1, wherein the sand control valve is positioned above the injection assembly.

9. The system of claim 8, wherein the sand control valve is configured to flush sand from the annulus after a fracturing operation.

10. A method for stimulating and flushing a well with an annulus formed by a string and a wellbore, wherein the method comprises:

setting an upstream packer in an injection assembly upstream of a target zone at an activation pressure;

setting a downstream packer in the injection assembly downstream of the target zone at the activation pressure;

sealing, via a control element, the annulus between the string and the wellbore, the control element being positioned upstream from the target zone and the injection assembly;

positioning a control valve upstream from the injection assembly, downstream from the control element, and between the injection assembly and the control element; and exposing ports within the control valve when the upstream packer and the downstream packer are unset.

11. The method of claim 10, further comprising:

positioning an injection valve between the upstream packer and the downstream packer, wherein the control element is a sand and debris control element and the control valve is a sand and debris control valve.

12. The method of claim 11, further comprising:

opening the injection valve when a bore pressure is above the activation pressure.

13. The method of claim 10, further comprising:

setting a releasable anchor in the wellbore downstream from the control valve, the releasable anchor being configured to be set to prevent axial and rotational motion of the injection assembly.

14. The method of claim 10, further comprising:

positioning a first sand control packer upstream from the control element , the first sand control packer being configured to seal the annulus between the string and the wellbore; and positioning a second sand control packer downstream from the control element, the second sand control packer being configured to seal the annulus between the string and the wellbore, wherein the control valve is positioned downstream from the first sand control packer, upstream from the second sand control packer, and between the first sand control packer and the second sand control packer.

15. The method of claim 10, further comprising:

positioning a check valve upstream from the control valve, wherein the check valve prevents a return flow toward the surface through the string.

16. The method of claim 10, further comprising:

positioning a bottom valve on a distal end of the string.

17. The method of claim 10, wherein the control valve is positioned above the injection assembly.

18. The method of claim 17, further comprising:

flushing sand from the annulus after a fracturing operation via the control valve.

* * * * *